United States Patent [19]

Brown

[11] Patent Number: 5,048,443

[45] Date of Patent: Sep. 17, 1991

[54] SAIL HANDLING SYSTEM

[76] Inventor: Thomas G. S. Brown, Box 17, Site 17, RR #4, Armdale, Nova Scotia, Canada, B3L 4J4

[21] Appl. No.: 512,314

[22] Filed: Apr. 23, 1990

[30] Foreign Application Priority Data

Apr. 24, 1989 [CA] Canada ..... 597525

[51] Int. Cl.[5] ..... B63H 9/04

[52] U.S. Cl. ..... 114/104; 114/105; 114/108

[58] Field of Search ..... 114/39.1, 102-108, 114/112

[56] References Cited

U.S. PATENT DOCUMENTS 2,620,760 12/1952 Melges ..... 114/103
4,487,147 12/1984 Hoyt ..... 114/104
4,688,506 8/1987 van Breems ..... 114/104

OTHER PUBLICATIONS

North Sailing Systems Advertisement.
Dutchman ® Advertisement.
Dutchman ® Sales Literature.
Doyle Sales Memorandum.

*Primary Examiner*—Ed Swinehart
*Attorney, Agent, or Firm*—R. Craig Armstrong

[57] ABSTRACT

The specification discloses a sail handling system having a series of lines interwoven through a sail, and lines passing through grommets on the sail to prevent the sail from falling freely down the mast and to stack the sail. The sail handling system has particular application for the safe hauling down and stacking of a main sail above the boom, or in the case of a jib sail, upon the deck of a sailboat. Application of tension down one or more hauldown stacking lines interwoven through a series of grommets installed in the body of the sail enables the sail to be hauled down and stacked safely.

2 Claims, 6 Drawing Sheets

SAIL HANDLING SYSTEM

BACKGROUND OF THE INVENTION

1. Field of the Invention

This invention relates in general to sail handling, and more particularly to a sail handling system which prevents a sail from falling freely and instead stacks the sail in a controlled manner by means of lines interwoven through the sail.

1. Description of the Prior Art

On the subject of sail handling, a raised sail when its halyard is let go normally falls freely down the mast which results in a great deal of the sail body lying over the deck, thus requiring much crew time and work to snug the sail over its the boom of the sailboat, sometimes at great risk to the crew and certainly necessitating extensive handling of the sail, thereby causing wear and tear of the sail itself. Sail makers have developed many ways to stack the main sail over the boom, around the boom, into the mast or along the mast. None of these ways involves a through the sail positive hauldown stacking line which flakes and stacks the sail, and holds the sail down without the conventional ties and works, nor do any of these ways function with the normal jib head sail equally as well as with the main sail.

SUMMARY OF THE INVENTION

It is an object of the invention to provide a sail handling system which provides adjustable lowering and stacking of sails, determined by the tension applied to lines interwoven through the sail. The invention has particular application to the safe hauling down and stacking of sails, both main sails and jib sails. The invention is a relatively inexpensive and simple system which may be installed by a sailmaker on sails removed from the sailboat, obviating any need for costly transport of the sailboat to a boatyard, and thereby facilitating the installation of the invention on existing sailboats.

In the invention, the sail handling system includes on or more hauldown stacking lines interwoven through a sail and means to prevent the sail from falling freely. The invention will enable a main sail to be flaked and stacked over the boom, and in the case of a jib sail will stack it on the deck without direct handling of the sail, by the manipulation of the sail handling system only.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which:

FIG. 5 is a side perspective view of an alternate embodiment installed in a sail shown in a partly flaked and stacked position over the boom, using a luff-leech hauldown stacking line;

DETAILED DESCRIPTION OF THE PREFERRED EMBODIMENT

Figure 1:
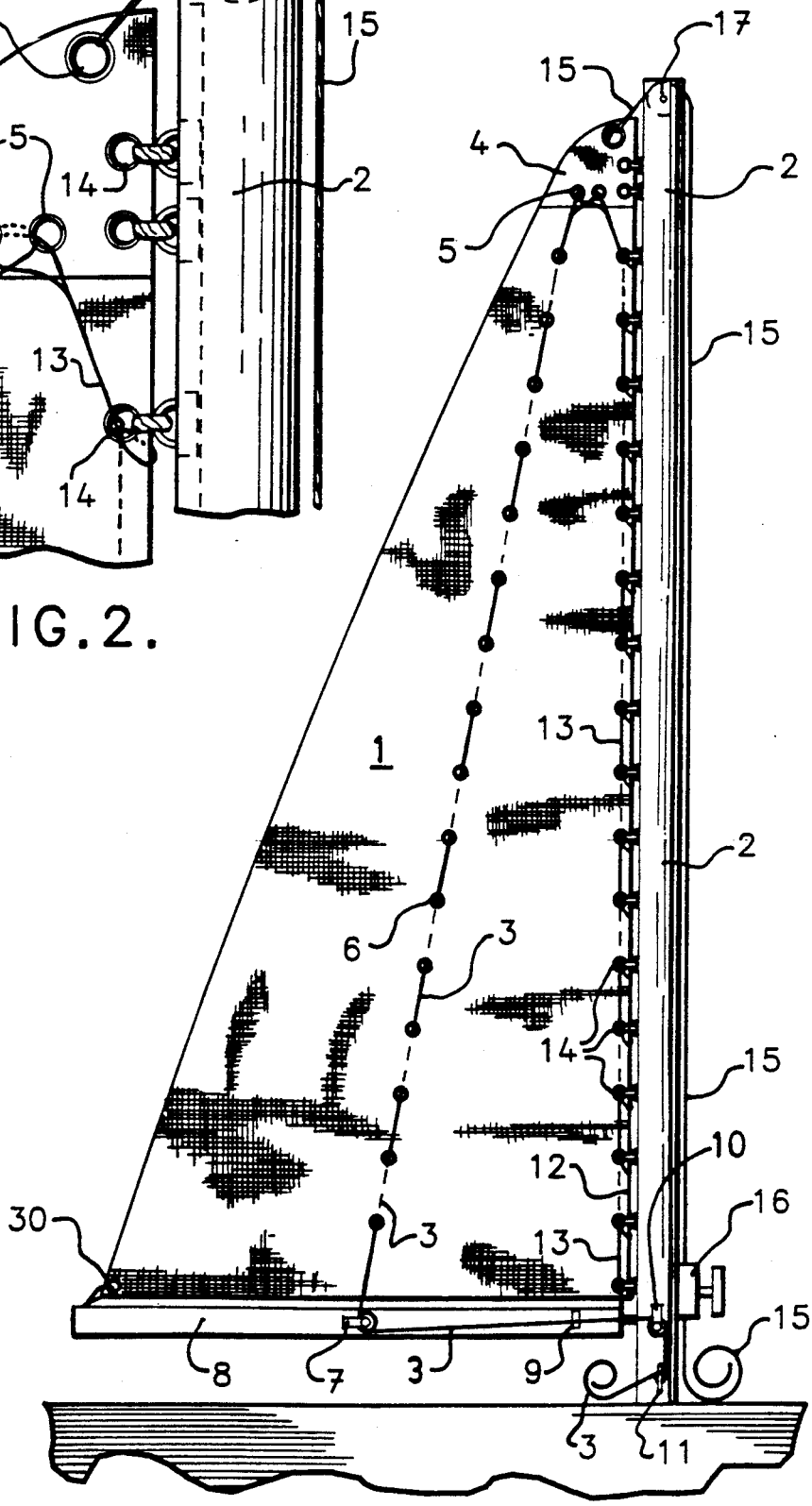
FIG. 1 is a side view of the preferred embodiment installed in a main sail.

Referring to FIG. 1, the sail handling system comprises a main sail 1, shown in the raised position on its mast 2, having a hauldown stacking line 3 spliced at the sail head piece 4 through eyelets, grommets or the like 5 installed in the sail head piece. The hauldown stacking line is loosely woven in and out of sail grommets, eyelets or the like 6 installed in the body of the sail in a line angled downwardly and outwardly from a point near to and beneath the head piece to a point near the lowermost portion of the mid-region of the sail. The hauldown stacking line extends down through the sail (interwoven through the sail grommets) to a cheek block 7 mounted on the mid-region of the boom 8, passes through the boom cheek block and through a guiding eye 9 adjacent the boom cheek block 7. The guiding eye is secured at the end of the boom nearest the mast, and is positioned near a second cheek block 10 secured to the bottom of the mast. The hauldown stacking line passes through and around this mast cheek block, and is then made fast at a mast cleat or the like 11 secured to the lowermost end of the mast or to a deck cleat or the like.

Referring to FIG. 1, the preferred embodiment further comprises a halyard 15 which runs parallel to the mast on the side of the mast opposite the sail. The halyard passes through an adjustable friction stop 16 on its way up the mast 2 and enters the mast at its head, then passes over the halyard mast heads or turning block or the like, heaves out the opposite side and ends made fast to the sail 1, head piece 4 and cringle 18. The adjustable friction stop 16 prevents the sail from falling freely when the halyard 15 is let go and allows the hauldown stacking line 3 to bring the sail down over the boom 8 in a controlled manner.

Figure 2:
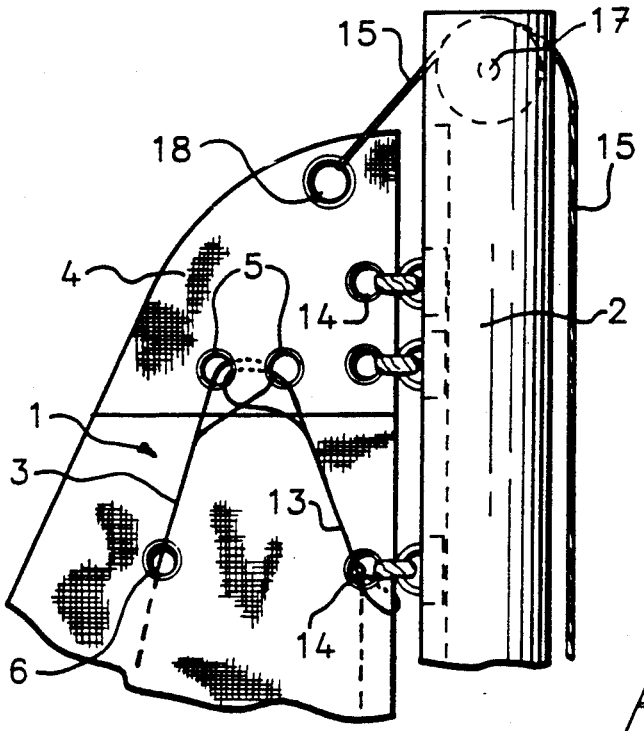
FIG. 2 is a close up view of the embodiment shown in FIG. 1, showing detail at the sail headpiece.

The preferred embodiment further comprises at the luff 12 of the sail, a shock cord 13 interwoven continuously through luff grommets 14 installed in the luff of the sail in a line extending vertically from the lowermost bottom corner of the sail to a point at the top side of the head piece. Referring to FIG. 2, the shock cord 13 is tied at each luff grommet 14, causing the shock cord to be stretched when the sail is raised to its full height. The purpose of the shock cord is to help the hauldown stacking line 3 force each section of sail to flake on its opposite side of the mast. When the halyard is released and tension is applied to the hauldown stacking line, the sail starts to fall. As the sail falls, the shock cord helps turn the luff in the desired direction for stacking.

Figure 3:
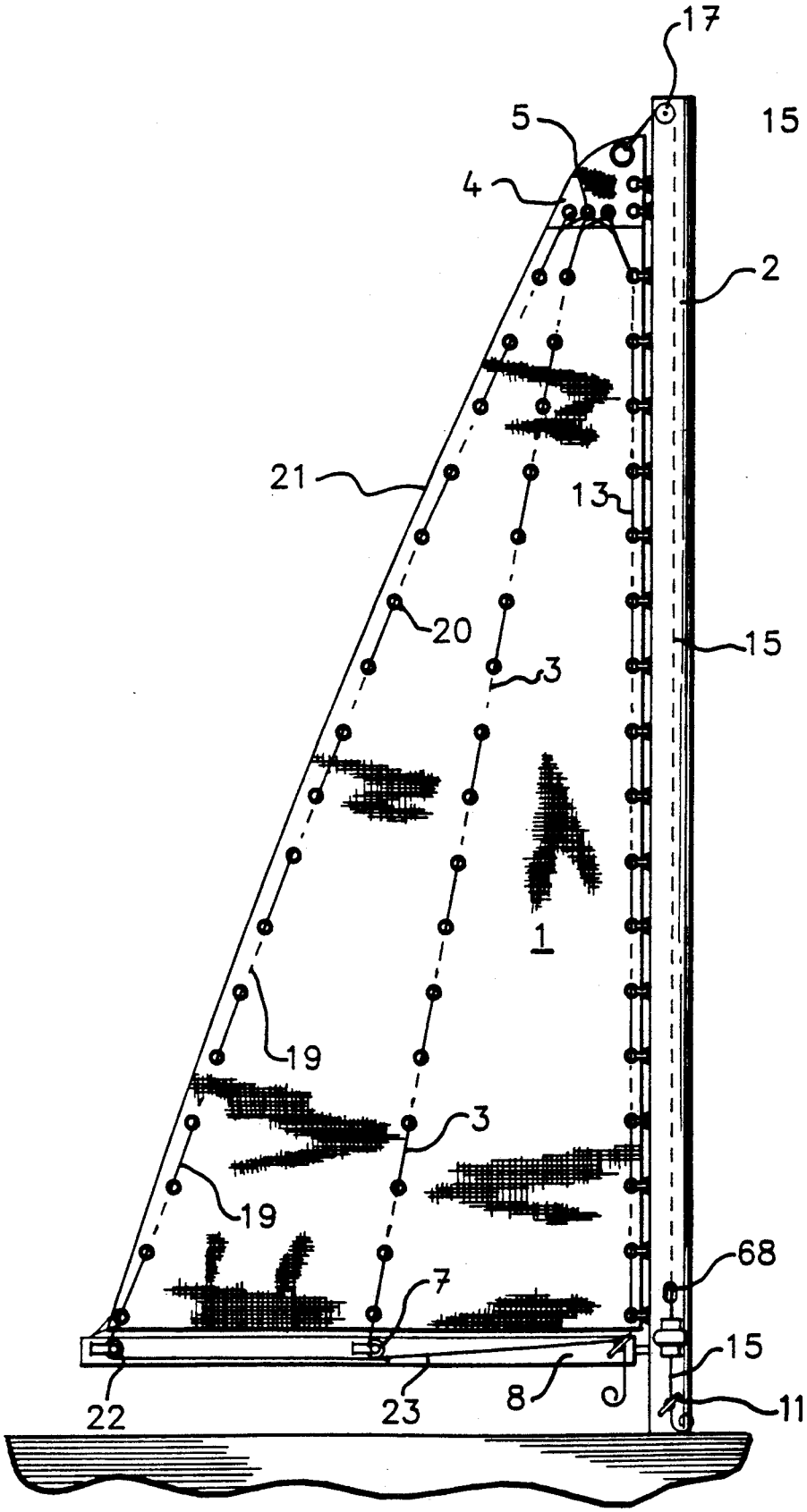
FIG. 3 is a side view of an alternate embodiment installed in a very large sail.

FIG. 3 shows one such alternate embodiment of the invention comprising an additional "leech" hauldown stacking line 19; the topmost end of which leech hauldown stacking line is made fast to the head piece 4, sharing eyelets, grommets or the like with the through the sail body hauldown stacking line 3 and the luff shock cord 13. In this alternative embodiment, the topmost end of the leech hauldown stacking line extends down from the headboard and is interwoven through leech grommets, eyelets or the like 20 which are installed in the sail 1 in a substantially vertical line extending down the length of the leech of the sail 21 to the lowermost corner at the leech of the sail. From this lowermost corner, the leech hauldown stacking line passes through a leech hauldown cheek block 22 mounted on the boom 8, and the free end of the leech hauldown stacking line is spliced directly to the through the sail hauldown stacking line at a point 23 which is adjacent cheek block 7 on the side of cheek block 7 nearest the mast. Otherwise, the basic system is the same except the halyard in this instance runs up through the mast, its lowermost end exiting from the mast via a mast exit block 68, passing down through a friction stop 16, and made fast at a cleat 10 or the like secured to the mast or deck or other suitable place.

Figure 4:
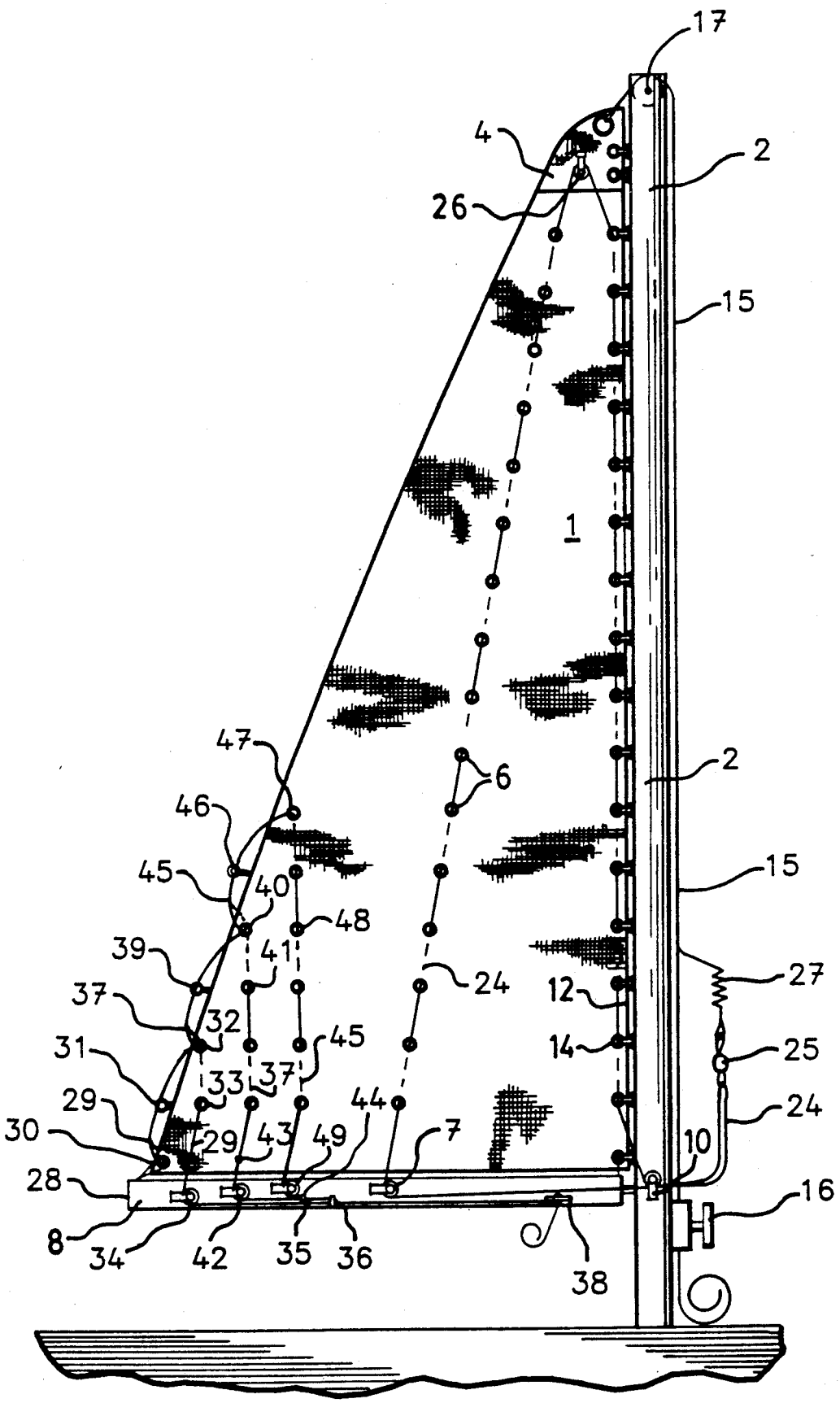
FIG. 4 is a side view of an alternate embodiment showing the through the sail reefing system and an alternate arrangement of the sail lines for controlling the sail dropping, flaking and automatic stacking of the sail.

FIG. 4 shows a second alternate embodiment of the sail handling system comprising a hauldown stacking line 24 similar to that of the preferred embodiment, and further comprising a means by which the hauldown stacking line is secured to the halyard. FIG. 4 shows this embodiment installed in a main sail which is fully raised. One end of the hauldown stacking line 24 runs through a hauldown cheek block 10 mounted on the lowermost vertical portion of the mast 2, and is then interwoven up through luff grommets 14 installed in the sail in a line extending vertically along the luff of the sail from the lowermost corner of the sail adjacent to the mast to a sail head piece 4 positioned at the top of the sail. The hauldown stacking line passes through and around a cheek block 26 mounted on the sail head piece and extends outwardly and downwardly from the sail head piece, interwoven through a line of sail grommets 6 angling downwardly and outwardly along the body of the sail toward the mid-region of the boom 8. From the lowermost leech grommet 20, the hauldown line 24 is wound through and around a leech cheek block 7 secured to the boom 8, and extends from the leech cheek block toward the mast, along the length of the boom, through the hauldown cheek block 10 mounted on the mast 2, where it meets that section of the hauldown stacking line 24 which runs up and through the luff grommets 14 and extends outwardly past the mast toward a halyard 15.

The hauldown stacking line 24 is linked to the halyard 15 by means of a double-eyed swivel switch 25 and a shock cord 27. The topmost end of the hauldown stacking line extending from the side of the hauldown cheek block 10 nearest the halyard line 15 (i.e. the side lying away from the sail), is passed through the lowermost eye of the swivel switch 25, and is spliced together with the other end of the hauldown stacking line to form a closed loop. The upper eye of the swivel switch 25 is secured to the lowermost end of the shock cord 27, and the upper end of the shock cord is made fast to the halyard 15. The halyard of the alternate embodiment shown in FIGS. 4 is linked to the mast in a manner similar to that described for the preferred embodiment. Referring to FIG. 4, in this second alternate embodiment, the halyard's free end can be positioned at any convenient location on the deck of the sailboat, its other end extends up and through the mast 2, then passes down over the halyard turning block 17 or one or more halyard mastheads or sheive or the like, at which point it is made fast to the sail 1, head piece 4, and cringle 18.

When the sail is to be dropped, the halyard 15 being connected to the sail 1 at the head piece 4 will be forced to move down the mast and up the mast due to the weight of the sail acting on both parts of the line. This causes the shock cord 27 which is connected to the halyard 15 to be taken along also. The hauldown stacking line 24 is pulled along with it, thus retaining tension on the body of the sail, allowing the sail to flake and stack over the boom automatically until the sail can no longer drop on its own. Now the hauldown stacking line 24 can be hauled on at a convenient location, in this case between the cheek block 10 and swivel 25. To flake the sail in the correct direction, the hauldown stacking line 24 should remain fairly taut, this in turn on most sail mast configurations will cause that section of the hauldown stacking line 24 which is going up the mast 2 with the halyard 15 to be shorter than that section of halyard 15 that is required to see the sail in a fully stacked position. The shock cord 27 is caused to stretch making up this difference, thus allowing the sail to be fully stacked over the boom. This system may be desired if the user does not want to have the hauldown stacking line lying around, or just wants a nice clean uncluttered system all going into the mast.

The alternate embodiment shown in FIG. 4 further comprises a reefing system which consists of lines of holes in the sail that are parallel to the sail slide and equally spaced having reef lines passing through the sail body, as opposed to the most common structure where reef lines are squeezed around the sail. Starting at the boom heel 28, the number one reef line 29 is spliced (made fast) at the sail's haul out 30, and the free end of the number one reef line is interwoven upwardly through number one reef leech ring 31 to number one leech reef cringle 32, passing down the other side and out through number one reef grommet 33, continuing down to number one cheek block 34 and along to a wipping 35, then through the end of a spliced eye 36 of number two reef line 37 until the wipping 35 is brought up to it, but it cannot pass through the eye 36, so now number two reef line 37 is hauled along with number one reef line 29. Thus, when number one reef line is fully reefed, number two reef line 37 is at hand ready to be utilized if required.

Number two reef line 37 has one of its ends spliced to number one reef cringle 32; its free end is sent up and through number two reef leech ring 39, continuing up and through number two reef cringle 40 then weaved down through number two reef grommets 41 and cheek block 42—the size of which is large enough to allow the wipping 43 in number two reef line 37 to pass through it and then through the spliced eye 44 at the free end of number three reef line 45. When number two reef line 37 is hauled on, its wipping 43 will not pass through the end eye splice 44 of number three reef line 45. Now, number three reef line will be brought up to the crewman who is doing the reefing and be at hand if it is required.

Number three reef line 45 has one of its ends spliced to number two leech reef cringle 40 and its free end sent up through number 3 leech reef ring 46, through number three reef cringle 47, then weaved down through number three reef grommets 48, to number three reef cheek block 49, through this block and ending with its eye spliced 44 around number two reef line 37. Thus, as previously stated, when number two reef line is hauled on, it brings number three reef line 45 with it; now number three reef line 45 is at hand and ready to be used. This reefing design provides a good foot tension and prevents rub through of the sail. The reefing design of the invention enables reefing to be performed very quickly and easily. Further, any knowledgeable sailor can rig these systems to make them controllable from the safety of the cockpit or mast area.

Figure 6:
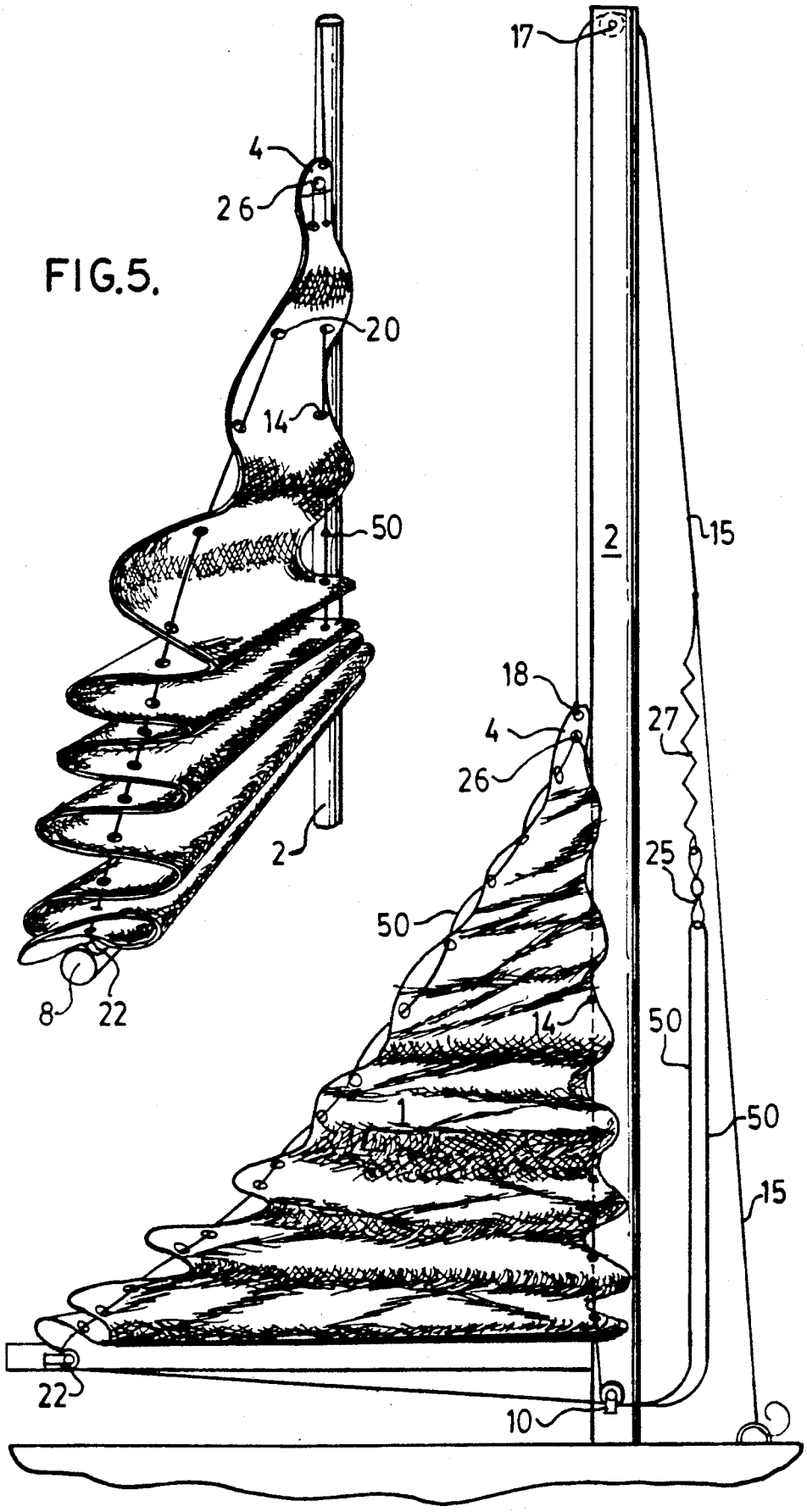
FIG. 6 is a side view of the alternate embodiment shown in FIG. 5.
Figure 7:
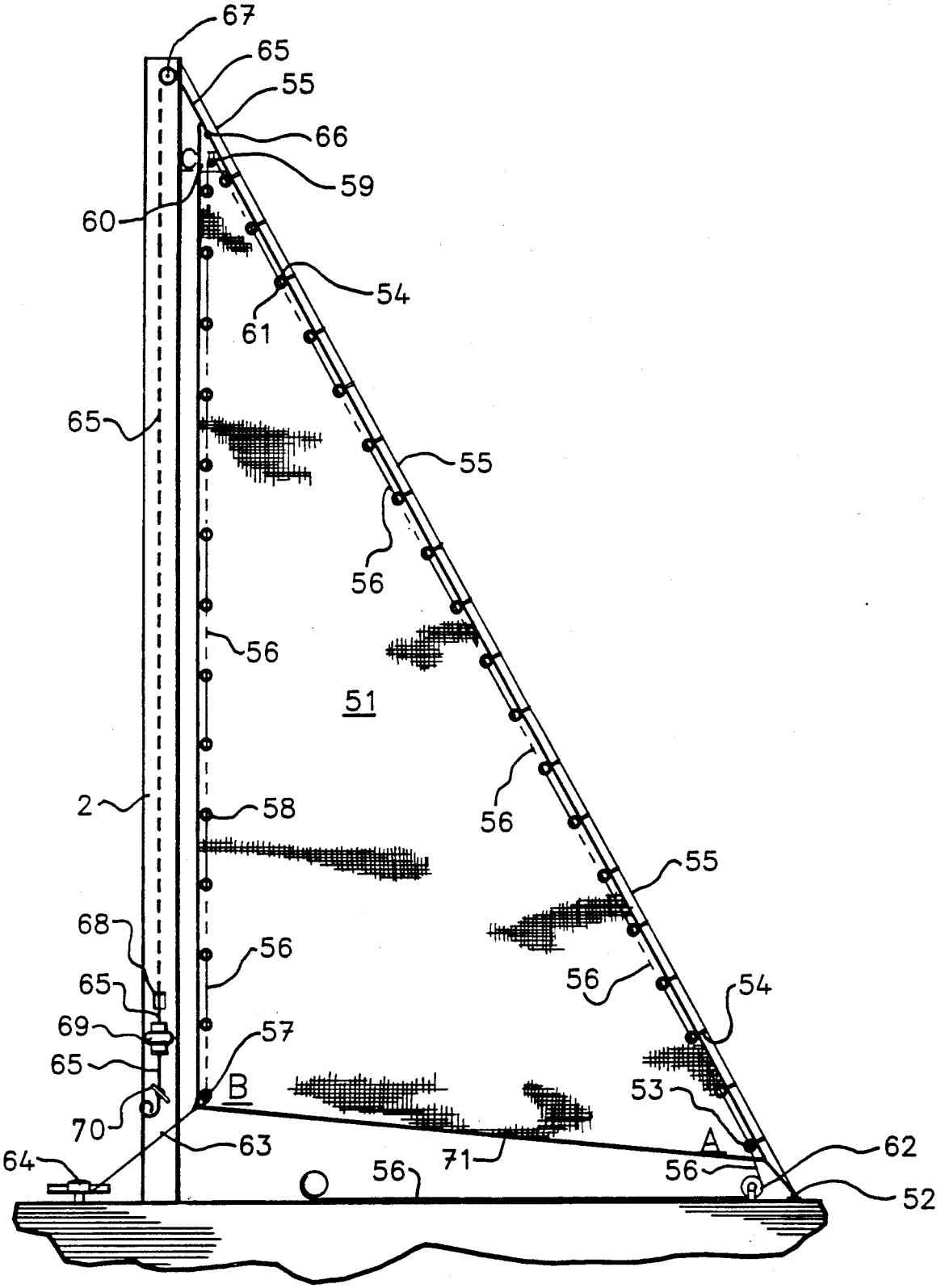
FIG. 7 is a side view of an alternate embodiment installed in a jib sail with the jib sail in the raised position, hanked to the forestay with the hauldown stacking line made fast at the clew cringle and running up the leech and down the luff.

FIGS. 5 and 6 show a third alternate embodiment of the sail handling system comprising a "luff-leech" hauldown stacking line 50. Referring to FIGS. 5 and 7, the alternate embodiment comprises a luff-leech hauldown stacking line 50 interwoven through a sail 1 in a loop extending up the luff of the sail, and down along the leech of the sail. The sail of this alternate embodiment, shown in FIGS. 5 and 6, is partly flaked and stacked over a boom 8. One end of the hauldown stacking line 50 runs through a hauldown cheek block 10 mounted on the lowermost vertical portion of the mast 2, and is then interwoven up through luff grommets 14 installed in the sail in a line extending vertically along the luff of the sail from the lowermost corner of the sail adjacent to the mast to a sail head piece 4 positioned at the top of the sail. The hauldown stacking line passes through and around a cheek block 26 mounted on the sail head piece and extends outwardly and downwardly from the sail board head, interwoven through leech grommets 20 installed in a substantially vertical line angling downwardly and outwardly along the leech of the sail toward the outermost most end of the boom 8. From the lowermost leech grommet 20, the hauldown line is wound through and around a leech cheek block 22 secured to the boom 8, and extends from the leech cheek block toward the mast, along the length of the boom, through the hauldown cheek block 10 mounted on the mast 2, meeting with that section of the hauldown stacking line 50 which runs up and through the luff grommets 14 and extending past the mast toward a halyard 15.

The hauldown stacking line 50 is linked to the halyard 15 by means of a double-eyed swivel switch 25 and a shock cord 27. The topmost end of the hauldown stacking line extending from the side of the hauldown cheek block 10 nearest the halyard 15 (i.e. the side lying away from the sail), is passed through the lowermost eye of the swivel switch 25, and is spliced together with the other end of the hauldown stacking line to form a closed loop. The upper eye of the swivel switch 25 is secured to the lowermost end of the shock cord 27, and the upper end of the shock cord is made fast to the halyard 15. The halyard of the alternate embodiment shown in FIGS. 5 and 6 is linked to the mast in a manner similar to that described for the preferred embodiment. In the alternate embodiment, the halyard's free end can be positioned at any convenient location on the deck of the sailboat, its other end extends up and through the mast 2, then passes down over the halyard turning block 17, at which point it is made fast to the sail 1, head piece 4, and cringle 18.

In the alternative embodiment depicted in FIGS. 5 and 6, the section of hauldown stacking line which is interwoven through the luff of the sail could as easily be adapted to run through the body of the sail. The through the body of the sail design is most effective, but some people may not like lines passing through their sailbody.

On the main sail, if one installs grommets or rings along the leech at an angle of 90 degrees to the luff and parallel to the slides, or in the case of a jib sail, "hanks" may be installed, a jib sail as in FIG. 7 may be flaked and stacked in the same manner as a main sail other than lying on the deck. FIG. 7 shows this embodiment installed in a jib sail 51 in the raised position. The jib sail is made fast to a deck eye 52 from a tack cringle 53 installed in the corner of the jib sail which is angled toward the deck and is positioned furthest from the mast. The jib sail is also secured by means of several hanks 54 to a head stay 55 which extends downwardly and outwardly from the topmost part the mast 2 to the deck eye 52 to which it is tied. The alternate embodiment shown in FIG. 7 further comprises a jib hauldown stacking line 56, one end of which is made fast to a jib clew cringle 57 installed in the corner of the jib sail nearest the lower end of the mast 2. The free end of the jib hauldown stacking line 56 is interwoven upwardly through jib leech grommets 58 to a cheek block 59 secured to the jib head 60, and is extended outwardly away from the mast through the cheek block 59 and then is interwoven downwardly through luff grommets 61 (the jib hauldown stacking line may share these grommets 61 with the hanks 54). The jib hauldown stacking line exits from the jib sail through the tack cringle 53, extending downwardly to a jib hauldown stacking deck block 62 secured to the deck beneath the outermost corner of the jib sail, and passes through the stacking deck block with its free end extending toward the mast to a suitable position at the mast or cockpit (not shown). The jib sheet 63 is made fast to the same jib clew cringle 57 to which the jib hauldown stacking line 56 is secured. The free end of the jib sheet 63 is made fast to a convenient control position, in this instance, to a cleat 64 mounted on the deck on the side of the mast opposite to the jib sail.

In the alternate embodiment shown in FIG. 7, the jib halyard 65 is tied to the jib head cringle 66 at the top most corner of the jib. The free end of the jib halyard is extended upwardly into the mast 2 and mounted inside the mast around its sheive 67, halyard mastheads or turning block or the like, after which the jib halyard extends downwardly through the inside of the mast 2 and is brought out of the mast at a mast exit box 68 positioned near the lowermost end of the mast. From the mast exit box 68, the jib halyard extends through a jib friction stop 69 mounted to the lower portion of the mast beneath the mast exit box 68 and above a jib cleat 70 also secured to the mast, and is then made fast to the jib cleat 70.

Figure 8:
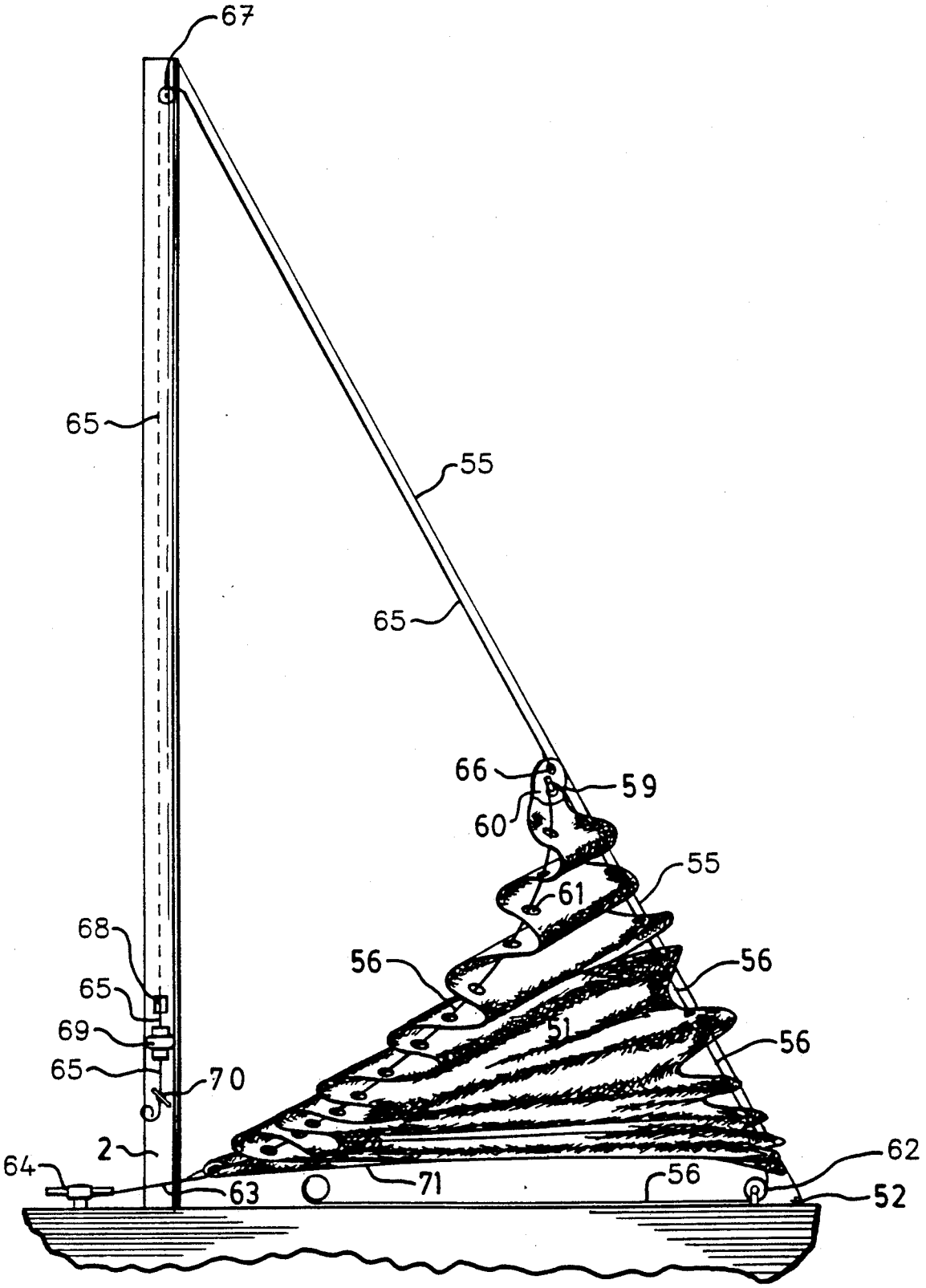
FIG. 8 is a side perspective view of an alternate embodiment installed in a jib sail hanked to the forestay in a flaked and partly stacked position close to the deck, with the jib sheet line still made fast.

FIG. 8 shows the alternate embodiment shown in FIG. 7 with the jib sail 51 being partly flaked and stacked close to the deck. Referring to FIG. 8, the jib sheet line is made fast to the deck cleat 64; the jib sail is also secured to the deck by means of the head stay 55 which extends downwardly and outwardly from the topmost part of the mast 2 to the deck eye 52 to which it is tied. In FIG. 8, the jib halyard 65 has been let go, but the jib friction stop 69 mounted to the lower portion of the mast prevents the jib sail 51 from falling freely. Because the jib sheet 63 is made fast at both ends, the jib foot 71 is kept tight, allowing the jib sail to be flaked and stacked a tension is applied to the jib hauldown stacking line 56 to haul the jib sail down.

It will be appreciated that the above description related to the preferred and alternative embodiments by way of example only. Many variations on the invention will be obvious to those knowledgeable in the field, and such obvious variations are within the scope of the invention as described and claimed, whether or not expressly described.

What is claimed as the invention is:

1. A sail handling system adaptable to installation with a sail on a mast, where said sail is hauled up by a halyard running up said mast, passing over the top of said mast, and thence being secured to a head piece at the top of said sail, said system comprising at least one hauldown stacking line, the first end of each said hauldown stacking line being securable to said head piece, the second end of each said hauldown stacking line being routed downwardly and interwoven through a plurality of grommet means installed in said sail in a line extending generally from top to bottom of said sail, whereby said sail may be hauled down the mast and stacked by pulling downwardly on each said hauldown stacking line while controlling release of tension on said halyard.

2. A sail handling system as recited in claim 1, where said second end of each said hauldown stacking line is attached to the free end of said halyard, such that said halyard together with any one of said hauldown lines each forms a continuous loop, the position of said sail being therefore controllable by rotation of one of said loops.

* * * * *